US005789343A

United States Patent [19]

Guistina et al.

[11] Patent Number: 5,789,343

[45] Date of Patent: Aug. 4, 1998

[54] ASSEMBLAGE FOR THERMAL DYE TRANSFER

[75] Inventors: Robert A. Guistina, Rochester; Wayne A. Bowman, Walworth; Elizabeth G. Burns, Rochester; Susan L. Dawson, Pittsford; Kristine B. Lawrence; Richard C. VanHanehem, both of Rochester, all of N.Y.

[73] Assignee: Eastman Kodak Company, Rochester, N.Y.

[21] Appl. No.: 879,061

[22] Filed: Jun. 19, 1997

[51] Int. Cl.[6] ..... B41M 5/35; B41M 5/38

[52] U.S. Cl. ..... 503/227; 428/195; 428/500; 428/913; 428/914

[58] Field of Search ..... 8/871; 428/195, 428/500, 913, 914; 503/227

[56] References Cited

U.S. PATENT DOCUMENTS 4,668,560 5/1987 Kobayashi et al. ..... 503/227

5,523,274 6/1996 Shuttleworth et al. ..... 503/227

5,627,128 5/1997 Bowman et al. ..... 503/227

*Primary Examiner*—Bruce H. Hess

*Attorney, Agent, or Firm*—Harold E. Cole

[57] ABSTRACT

A thermal dye transfer assemblage comprising:

(I) a dye-donor element comprising a support having thereon sequentially repeating dye layer patches of a dye dispersed in a polymeric binder, at least one of the dye patches containing a deprotonated cationic dye which is capable of being reprotonated to a cationic dye having a N—H group which is part of a conjugated system; and (II) a dye-receiving element comprising a support having thereon a polymeric dye image-receiving layer comprising a vinyl polymer having no or only slight acidity and a hydrated transition metal or metalloid salt of a strong acid, the dye-receiving element being in a superposed relationship with the dye-donor element so that the dye layer is in contact with the polymeric dye image-receiving layer.

12 Claims, No Drawings

ASSEMBLAGE FOR THERMAL DYE TRANSFER

CROSS REFERENCE TO RELATED APPLICATIONS

Reference is made to commonly-assigned U.S. patent application Ser. Nos. 08/878,924, filed concurrently herewith, entitled "Assemblage for Thermal Dye Transfer" by Bowman et al; 08/878,717, filed concurrently herewith, entitled "Thermal Dye Transfer Assemblage With Low Tg Polymeric Receiver Mixture" by Harrison et al; 08/878,951, filed concurrently herewith, entitled "Thermal Dye Transfer Assemblage With Low Tg Polymeric Receiver Mixture" by Kung et al; 08/878,564, filed concurrently herewith, entitled "Thermal Dye Transfer Assemblage" by Evans et al; 08/878,565, filed concurrently herewith, entitled "Thermal Dye Transfer Assemblage With Low Tg Polymeric Receiver Mixture" by Lawrence et al; and 08/878,704, filed concurrently herewith, entitled "Assemblage for Thermal Dye Transfer" by Evans et al, the teachings of which are incorporated herein by reference.

FIELD OF THE INVENTION

This invention relates to a thermal dye transfer assemblage wherein the receiver element contains a vinyl polymer and an acidic metal salt and the dye-donor element contains a deprotonated cationic dye.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye receiver polymer should have good affinity for the dye and provide a stable (to heat and light) environment for the dye after transfer. In particular, the transferred dye image should be resistant to image degradation by contact with other surfaces, chemicals, fingerprints, etc. Such image degradation is often the result of continued migration of the transferred dyes after the printing step.

Commonly used dyes are nonionic in character because of the easy thermal transfer achievable with this type of compound. The dye-receiver layer usually comprises an organic polymer with polar groups to accept the dyes transferred to it. A disadvantage of such a system is that, since the dyes are designed to be mobile within the receiver polymer matrix, the prints generated can suffer from dye migration over time.

A number of attempts have been made to overcome the dye migration problem which usually involves creating some kind of bond between the transferred dye and the polymer of the dye image-receiving layer. One such approach involves the transfer of a cationic dye to an anionic dye-receiving layer, thereby forming an electrostatic bond between the two. However, this technique involves the transfer of a cationic species which, in general, is less efficient than the transfer of a nonionic species.

DESCRIPTION OF RELATED ART

U.S. Pat. No. 5,523,274 relates to the transfer of a deprotonated cationic dye to a dye image-receiving layer containing an organic acid moiety as part of an acrylic ester polymer chain having a Tg of less than 25° C. which is capable of reprotonating the deprotonated cationic dye. There is no disclosure in this patent that describes the use of mixtures comprising a metal salt capable of reprotonating the deprotonated cationic dyes and a polymer having no or only slight acidity. In addition, there is a problem with the polymers used in this patent in that they contain strong acids which catalyze the hydrolysis of the acrylic esters which changes the properties of the polymer making it more hygroscopic and tacky.

U.S. Pat. No. 5,627,128 relates to the transfer of a deprotonated cationic dye to a polymeric dye image-receiving layer comprising a mixture of an organic polymeric or oligomeric acid which is capable of reprotonating the deprotonated cationic dye and a polymer having a Tg of less than about 19° C. and having no or only slight acidity, such as an acrylic, styrene or vinyl polymer which contains ester groups. There is a problem with this polymer mixture, however, in that such organic polymeric or oligomeric acids cause hydrolysis of such ester groups which causes physical properties of the receiver layer to change over time. In addition, there is no disclosure in this patent that describes the use of hydrated transition metal or metalloid salts of strong acids in the receiver to reprotonate the deprotonated cationic dyes.

U.S. Pat. No. 4,668,560 relates to a receiver element which contains a metal compound derived from metal salts of organic acids. However, there is a problem with this type of receiver element in that it does not reprotonate a deprotonated cationic dye transferred to it.

It is an object of this invention to provide a thermal dye transfer assemblage which contains a receiver polymer which is hydrolytically stable. It is another object of this invention to provide a thermal dye transfer assemblage which will reprotonate a deprotonated cationic dye transferred to it.

SUMMARY OF THE INVENTION

These and other objects are achieved in accordance with this invention which relates to a thermal dye transfer assemblage comprising:

(I) a dye-donor element comprising a support having thereon sequentially repeating dye layer patches of a dye dispersed in a polymeric binder, at least one of the dye patches containing a deprotonated cationic dye which is capable of being reprotonated to a cationic dye having a N—H group which is part of a conjugated system; and (II) a dye-receiving element comprising a support having thereon a polymeric dye image-receiving layer comprising a vinyl polymer having no or only slight acidity and a hydrated transition metal or metalloid salt of a strong acid, the dye-receiving element being in a superposed relationship with the dye-donor element so that the dye layer is in contact with the polymeric dye image-receiving layer.

DESCRIPTION OF THE PREFERRED EMBODIMENTS

Deprotonated cationic dyes useful in the invention which are capable of being reprotonated to a cationic dye having a N—H group which is part of a conjugated system are described in U.S. Pat. No. 5,523,274, the disclosure of which is hereby incorporated by reference.

In a preferred embodiment of the invention, the deprotonated cationic dye employed in the invention and the corresponding cationic dye having a N—H group which is part of a conjugated system have the following structures:

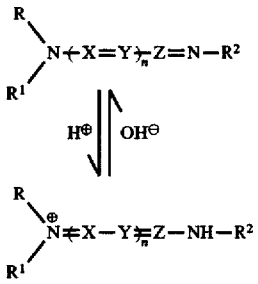

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents a substituted or unsubstituted phenyl or naphthyl group or a substituted or unsubstituted alkyl group from about 1 to about 10 carbon atoms; and n is an integer of from 0 to 11.

The deprotonated cationic dyes according to the above formula are disclosed in U.S. Pat. Nos. 4,880,769, 4,137,042 and 5,559,076, and in K. Venkataraman ed., *The Chemistry of Synthetic Dyes*, Vol. IV, p. 161, Academic Press, 1971, the disclosures of which are hereby incorporated by reference. Specific examples of such dyes include the following (the λmax values and color descriptions in parentheses refer to the dye in its protonated form):

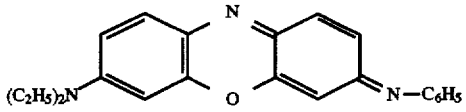

Dye 1
λ max 556 nm (641 nm)
magenta (cyan)
U.S. Pat. No. 4,880,769 (Dye 1)

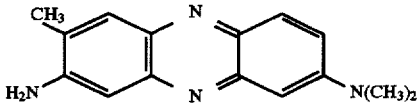

-continued

Dye 2
λ max 459 nm (536 nm)
yellow (magenta)

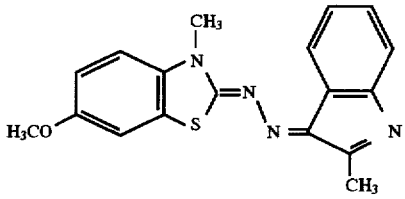

Dye 3
λ max 459 nm (522 nm)
yellow (magenta)

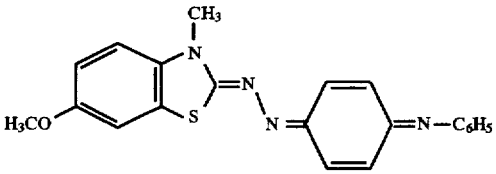

Dye 4
λ max 503 nm (621 nm)
red (blue)

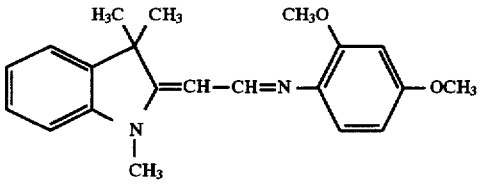

Dye 5
λ max 379 nm (405 nm)
yellow (yellow)

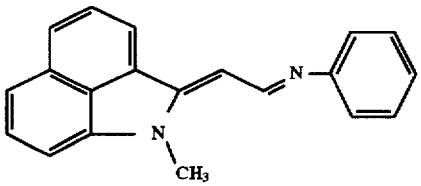

Dye 6
λmax 479 nm (513 nm)
yellow (magenta)

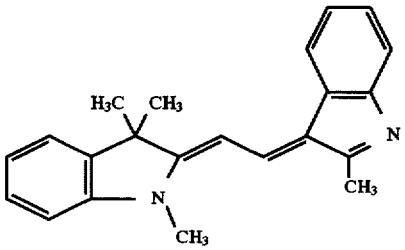

Dye 7
λmax 485 nm (495)
yellow (yellow)

-continued

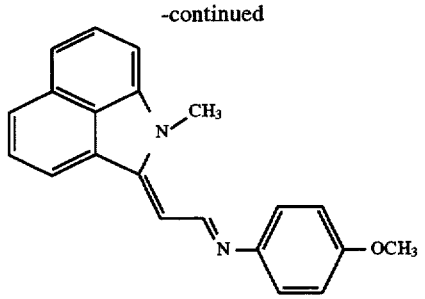

Dye 8
yellow (magenta)
U.S. Pat. No. 5,559,076 (dye precursor 5)

The dyes described above may be employed in any amount effective for the intended purpose. In general, good results have been obtained when the dye is present in an amount of from about 0.05 to about 1.0 g/m$^2$, preferably from about 0.1 to about 0.5 g/m$^2$. Dye mixtures may also be used.

The hydrated transition metal metalloid salt of a strong acid useful in the invention include various hydrated forms of the following transition metal or metalloid salts: aluminum sulfate, aluminum nitrate, aluminum chloride, potassium aluminum sulfate (alum), zinc sulfate, zinc nitrate, zinc chloride, nickel sulfate, nickel nitrate, nickel chloride, ferric sulfate, ferric chloride, ferric nitrate, cupric sulfate, cupric chloride, cupric nitrate, antimony (III) chloride, cobalt (II) chloride, ferrous sulfate, stannic chloride, aluminum trichloroacetate, zinc bromide, aluminum tosylate, zirconium (IV) chloride, etc. Mixtures of the above salts and complex salts thereof may also be used. In a preferred embodiment of the invention, the following hydrated transition metal and metalloid salts of a strong acid may be used:

MS-1: $Al_2(SO_4)_3 \cdot 18H_2O$
MS-2: $AlK(SO_4)_2 \cdot 12H_2O$
MS-3: $NiSO_4 \cdot 6H_2O$
MS-4: $ZnSO_4 \cdot 7H_2O$
MS-5: $CuSO_4 \cdot 5H_2O$
MS-6: $Fe_2(SO_4)_3 \cdot 4H_2O$
MS-7: $Al(NO_3)_3 \cdot 9H_2O$
MS-8: $Ni(NO_3)_2 \cdot 6H_2O$
MS-9: $Zn(NO_3)_2 \cdot 6H_2O$
MS-10: $Fe(NO_3)_3 \cdot 9H_2O$
MS-11: $AlCl_3 \cdot 6H_2O$ Any amount of hydrated transition metal or metalloid salt of a strong acid can be used in the receiver as long as it is sufficient to fully protonate the dyes transferred to the receiver. In general, good results have been obtained when the hydrated transition metal or metalloid salt of a strong acid is employed at a concentration of from about 0.05 to about 1.5 g/m$^2$, preferably from about 0.1 to about 0.8 g/m$^2$.

In a preferred embodiment of the invention, the vinyl polymer having no or only slight acidity employed in the dye image-receiving layer comprises repeating units derived from acrylic acid, styrene, or esters or amides of acrylic acid, such as poly(acrylic acid), poly(acrylic acid-co-hydroxyethyl acrylate), poly(hydroxyethyl acrylate), poly (hydroxyethyl acrylate-co-hydroxyethyl methacrylate), poly (1,1-dimethylbut-(-2-one)-co-acrylamide), poly(1,1-dimethylbut(-2-one)-co-acrylamide-co-hydroxyethyl acrylate), poly(hydroxyethyl acrylate-co-N,N-dimethylacrylamide), poly(N,N-dimethylacrylamide), poly (t-butylacrylamide), poly(hydroxyethyl acrylate-co-t-butylacrylamide), poly isopropylacrylamide, poly(N-methyl-acrylamide), poly(vinyl alcohol), etc. In another preferred embodiment, the vinyl polymer comprises poly (butyl acrylate-co-allyl methacrylate) core with poly (glycidyl methacrylate) shell, poly(methyl methacrylate-co-butyl acrylate-co-2-hydroxyethyl methacrylate-co-2-sulfoethyl methacrylate, sodium salt), poly(styrene-co-butyl methacrylate-co-hydroxyethyl acrylate), poly(styrene-co-butyl methacrylate-co-methacrylamide), poly(styrene-co-butyl methacrylate-co-N,N-dimethylacrylamide), poly (styrene-co-butyl methacrylate-co-ethoxyethyl methacrylate), poly(butyl methacrylate-co-acrylamide) or poly(butyl methacrylate-co-styrene-co-acrylamide). These polymers may also be polymerized in a core shell configuration.

The vinyl polymer having no or only slight acidity employed in the dye image-receiving layer may be present in any amount which is effective for its intended purpose. In general, good results have been obtained at a concentration of from about 0.5 to about 10 g/m$^2$. The polymers may be coated from organic solvents or water, if desired.

The support for the dye-receiving element employed in the invention may be transparent or reflective, and may comprise a polymeric, synthetic or cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

Any material can be used as the support for the dye-donor element employed in the invention, provided it is dimensionally stable and can withstand the heat of the thermal print heads. Such materials include polyesters such as poly (ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 μm.

Dye-donor elements used in the invention conventionally comprise a support having thereon a dye layer containing the dyes as described above dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U.S. Pat. No. 4,700,207; or a poly (vinyl acetal) such as poly(vinyl alcohol-co-butyral). The binder may be used at a coverage of from about 0.1 to about 5 $g/m^2$.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of at least one of the dyes, as described above, capable of generating a cyan, magenta or yellow dye image and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB 2,083,726A.

When a three-color image is to be obtained, the assemblage described above is formed on three occasions during the time when heat is applied by the thermal printing head. After the first dye is transferred, the elements are peeled apart A second dye-donor element (or another area of the donor element with a different dye area) is then brought in register with the dye-receiving element and the process repeated. The third color is obtained in the same manner. After thermal dye transfer, the dye image-receiving layer contains a thermally-transferred dye image.

The following examples are provided to further illustrate the invention.

EXAMPLES

Example 1

The following polymers were used to prepare dye-receiving elements:

Polymer P-1 Poly(butyl acrylate-co-allyl methacrylate) 98:2 wt. core/poly(glycidyl methacrylate) 10 wt. shell To a 12 L 3-neck flask fitted with a stirrer and condenser were added 2400 mL degassed distilled water, 26.8 mL 45% Dowfax® 2A1 surfactant (Dow Chemical), and 8 g sodium carbonate. The flask was heated to 80° C. Subsequently, 4,4'azobis(4-cyanovaleric acid) (16 g 80% aqueous solution) was added followed by the contents from an addition flask containing 2400 mL degassed distilled water, 26.8 mL 45% Dowfax® 2A1 surfactant, 1176 g butyl acrylate and 24 g allyl methacrylate over a period of two hours. The pH of the resulting latex was adjusted to 7 with sodium carbonate, and the latex was stirred at 80° C. for one hour. Subsequently, 4,4'-azobis(4-cyanovaleric acid) (0.6 g 80% aqueous solution) was added followed by the contents from an addition flask containing 480 mL degassed distilled water, 130 g glycidyl methacrylate and 18 mL 45% Dowfax® 2A1 surfactant over a period of 90 min. The resulting latex was stirred at 80° C. for 2 hours and then cooled to 25° C. The pH was adjusted to 7 with sodium carbonate. The latex contained 19.9% solids and had a particle size of 92.8 nm and a Tg (glass transition temperature) of −40° C.

Polymer P-2 Poly(methyl methacrylate-co-butyl acrylate-co-2-hydroxyethyl methacrylate-co-2-sulfoethyl methacrylate sodium salt). 30:50:10:10 wt.

To a 5 L 3-neck flask fitted with a stirrer and condenser were added 970 mL degassed distilled water and 25 mL 50% Olin 10G® surfactant (Olin Corp.). The flask was heated to 80° C. Potassium persulfate (6.24 g) and 2.06 g sodium metabisulfite were added followed immediately by the contents from an addition flask containing 490 mL degassed distilled water, 25 mL of 50% Olin 10G® surfactant, 150 g methyl methacrylate, 320 g butyl acrylate, 56 g 2-hydroxyethyl methacrylate and 97 g 2-sulfoethyl methacrylate over a period of 60 min. The resulting latex was stirred at 80° C. under nitrogen for 90 min. and then cooled to 25° C. The pH was adjusted to 7 with 10% sodium hydroxide to give a latex containing 28.9% solids and having a Tg of −3° C.

Polymer P-3 Poly(styrene-co-butylmethacrylate-co-methacrylamide). (30:60:10)

Water (250 mL) was added to a 2-L 3-neck reaction flask equipped with an overhead stir motor and an inlet/addition adapter and purged with $N_2$. Olin 10G® surfactant (7 mL 50% solution) was added to the water. The reaction flask was held at 80° C. Water (115 mL) was purged with $N_2$ in a 3-neck addition funnel equipped with an overhead stirrer. To the nitrogen-purged water were added, in this order, 7 mL Olin 10G® surfactant (50% solution), styrene (31 g 0.3 mole), butyl methacrylate (85 g 0.6 mole) and methacrylamide (8.5 g, 0.10 mole). 4,4'-Azobis(4-cyanovaleric acid) (1.8 g 75% aqueous solution) was added to the reaction flask, and the monomer emulsion was added at a rate of 7.5 mL/min. After the addition was complete, another 1.8 g 4,4'-azobis(4-cyanovaleric acid) was added, and the reaction mixture was stirred at 80° C. for another two hours. The reaction vessel was cooled, and the dispersion filtered through large pore filter media (Pall Trinity polypropylene media KP04-103-050). The latex was found to be 24% solids, with a particle size of 123 nm and a Tg of 42° C.

Polymer P-4 Poly(styrene-co-butyl methacrylate-co-N-methylacrylamide). (30:60:10)

P-4 was made the same way as P-3, except that N-methylacrylamide (8.5 g, 0.10 mole) was used instead of hydroxyethyl acrylate. The latex was found to be 28% solids, with a particle size of 148 nm and a Tg of 41° C.

Polymer P-5 Poly(styrene-co-butyl methacrylate-co-N,N-dimethylacrylamide). (30:60:10)

P-5 was made the same way as P-3, except that N,N-dimethylacrylamide (8.5 g, 0.10 mole) was used instead of hydroxyethyl acrylate. The latex was found to be 26% solids, with a particle size of 142 nm and a Tg of 41° C.

Polymer P-6 Poly(styrene-co-butyl methacrylate-co-ethoxyethyl methacrylate). (30:60:10)

P-6 was made the same way as P-3, except that ethoxyethyl methacrylate (18.8 g, 0.10 mole) was used instead of hydroxyethyl acrylate. The latex was found to be 26% solids, with a particle size of 151 nm and a Tg of 39° C.

Polymer P-7 Poly(butyl methacrylate-co-styrene-co-acrylamide)

Water (250 mL) was added to a 2-L 3-neck reaction flask equipped with an overhead stir motor and an inlet/addition adapter and purged with $N_2$. Olin 10G® surfactant (7 mL 50% solution) was added to the water. The reaction flask was kept at 80° C. Water (115 mL) was purged with $N_2$ in a 3-neck addition funnel equipped with an overhead stirrer. To the nitrogen-purged water were added, in this order: 7 mL of Olin 10G® surfactant (50% solution), styrene (125 g, 0.3 mole), butyl methacrylate (339 g, 0.6 mole) and acrylamide (34 g, 0.10 mole). Subsequently, 4,4'-azobis(4-cyanovaleric acid) (1.8 g 75% aqueous solution) was added to the reaction flask, and the monomer emulsion was added at a rate of 7.5 mL/min. After the addition was complete, another 1.8 g 4,4'-azobis(4-cyanovaleric acid) was added, and the reaction mixture stirred at 80° C. for another two hours. The reaction vessel was cooled, and the dispersion filtered through large pore filter media (Pall Trinity polypropylene media KP04-103-050). The latex was found to be 27% solids, with a particle size of 129 nm and a Tg of 38° C.

Dye-Donor Elements

Individual dye-donor elements were prepared by coating the following compositions in the order listed on a 6 μm poly(ethylene terephthalate) support:

1) a subbing layer of Tyzor TBT®, a titanium tetrabutoxide, (DuPont Company) (0.16 g/m$^2$) coated from 1-butanol; and
2) an imaging dye layer coated from a tetrahydrofuran/cylopentanone (95/5) solvent mixture, whereby two different binder polymer mixtures with the selected dye as shown in Table 1 were used:
   DB-1 propionate ester of bisphenol A copolymer with epichlorohydrin (prepared by techniques similar to those described in U.S. Pat. No. 5,244,862);
   DB-2 poly(butyl methacrylate-co-Zonyl TM®) (75/25) where Zonyl TM® is a perfluoro monomer available from DuPont.

Details of dye and binder laydowns are summarized in the following Table 1:

TABLE 1

| Dye-Donor Element | Deprotonated Dye | Dye Laydown, (g/m$^2$) | DB-1 Laydown, (g/m$^2$) | DB-2 Laydown, (g/m$^2$) |
|---|---|---|---|---|
| Cyan | Dye 1 | 0.15 | 0.17 | 0.06 |

On the back side of the dye-donor element were coated the following compositions in the order listed:

1) a subbing layer of Tyzor TBT®, a titanium tetrabutoxide, (DuPont Company) (0.16 g/m$^2$) coated from 1-butanol; and
2) a slipping layer of 0.38 g/m$^2$ poly(vinyl acetal) (Sekisui), 0.022 g/m$^2$ Candelilla wax dispersion (7% in methanol), 0.011 g/m$^2$ PS513 amino-terminated polydimethylsiloxane (Huels) and 0.0003 g/m$^2$ p-toluenesulfonic acid coated from a 3-pentanone/distilled water (98/2) solvent mixture.

Control Receiver Element C-1

This element was prepared by coating a dye image-receiving layer of 6.73 g/m$^2$ of poly(butyl acrylate-co-2-acrylamido-2-methyl-propanesulfonic acid) 90:10 wt. ratio, (Tg=−45° C.) coated from distilled water on an unsubbed poly(ethylene terephthalate) support, (Estar®, Eastman Chemical Co.).

Control Receiver Element C-2

An acid-activated clay slurry was prepared by slurrying 10.0 g of Supreme Pro-Active® clay, 10.0 g 10% solution of Olin 10G® surfactant, and 80.0 g of high purity water. This slurry was added to a 16 oz (473 mL) glass jar with 250 ml of 1.8 mm zirconium oxide ceramic beads. The jar was placed on a SWECO® vibratory mill for 6 days. After milling, the slurry was separated from the beads. The final average slurry particle size was less than 1 μm.

The receiving element was prepared by coating the above slurry on a Textweb Proofing Paper® (Champion International Corporation) and dried to give a dye-receiving layer composed of 2.15 g/m$^2$ of acid-activated clay. This composition was analogous to the clay-coated paper referred to in U.S. Pat. No. 4,880,769.

Control Dye-Receiver Element C-3

The element was prepared by first extrusion laminating a paper core with a 38 μm thick microvoided composite film (OPPalyte® 350TW, Mobil Chemical Co.) as disclosed in U.S. Pat. No. 5,244,861. The composite film side of the resulting laminate was then coated with the following layers in the order recited:

1) a subbing layer of 0.02 g/m$^2$ Polymin P® polyethyleneimine (BASF) coated from distilled water; and
2) a dye-receiving layer composed of a mixture of 4.00 g/m$^2$ Vylon® 200 polyester (Toyobo Company Ltd.), 0.39 g/m$^2$ ethyl acetoacetate aluminum diisopropylate and 1.0 g/m$^2$ fumed silica (Cab-o-sil®, Cabot Corporation), coated from 2-butanone. This composition was analogous to Example 1 in U.S. Pat. No. 4,668,560.

Control Receiver Element C-4

This element was prepared the same as C-3, except the dye-receiving layer did not contain the fumed silica.

Control Receiver Element C-5

This element was prepared the same as C-3, except that the subbing layer was Prosil® 221 (0.05 g/m$^2$) and Prosil® 2210 (0.05 g/m$^2$) (PCR, Inc.) coated from 3A alcohol; and the dye image-receiving layer was a mixture of 2.69 g/m$^2$ of the polyester, poly[isophthalic acid-co-5-sulfoisophthalic acid (90:10 molar ratio)-diethylene glycol (100 molar ratio), (sulfonic acid of AQ29, Eastman Chemical Company), 4.04 g/m$^2$ of polymer P-1, and 0.022. g/m$^2$ of a fluorocarbon surfactant (Fluorad® FC-170, 3M Corporation), coated from distilled water. This composition was analogous to Receiver Elements 7 through 18 in Example 1 of U.S. Pat. No. 5,627,128.

Control Receiver Element C-6

This element was prepared the same as C-3, except the dye-receiving layer was 6.73 g/m$^2$ of Polymer P-1 and 0.022 g/m$^2$ of Fluorad FC-170® coated from distilled water.

Control Receiver Element C-7

This element was prepared the same as C-3, except the dye-receiving layer was 6.73 g/m$^2$ of Polymer P-2 and 0.022 g/m$^2$ of Fluorad FC-170® coated from distilled water.

Receiver Elements 1 through 29 of the Invention

Receiver Elements 1–10 were prepared as described above for Control Receiver Element 3, except the dye image-receiving layer was a mixture of metal salts MS-1, MS-3, MS-6, MS-9, or MS-11, and Polymer P-1 or Polymer P-2 coated from distilled water. The dry laydowns (g/m$^2$) for the metal salts were chosen to provide levels of acidity (based on molecular weight) equivalent to 0.59 g/m$^2$ of MS-1 ($Al_2(SO_4)_3 \cdot 18H_2O$). The total dry laydowns of the mixtures were kept constant at 6.73 g/m$^2$. The molecular weight (MW) of each metal salt and dry laydowns for the metal salts and receiver polymers are summarized in Table 2.

Receiver Element 11 was prepared as described above for Receiver Elements 1–10, except the dye-receiving layer was a mixture of 0.59 g/m$^2$ metal salt MS-1, 0.32 g/m$^2$ Dowfax 2A1® surfactant and 5.81 g/m$^2$ Polymer P-1 coated from distilled water.

Receiver Elements 12 through 29 were prepared as described above for Receiver Elements 1–10, except the dye-receiving layer was a mixture of metal salts MS-1 through MS-11 and Polymer P-1 or Polymer P-2 with no surfactant coated from distilled water. The dry laydowns ($g/m^2$) for MS-1 through MS-11 were chosen to provide levels of acidity (based on molecular weight) equivalent to 0.59 $g/m^2$ of MS-1 ($Al_2(SO_4)_3 \cdot 18H_2O$). The total dry laydowns of the mixtures were kept constant at 6.73 $g/m^2$. The molecular weight (MW) of each metal salt and dry laydowns for MS-1 through MS-11 and P-1 or P-2 are summarized in the following table:

TABLE 2

| Receiver Element | Metal Salt (MS) | MW of MS | Laydown of MS ($g/m^2$) | Laydown of P-1 ($g/m^2$) | Laydown of P-2 ($g/m^2$) |
|---|---|---|---|---|---|
| 1 | MS-1 | 666.45 | 0.59 | 6.14 | — |
| 2 | MS-11 | 241.43 | 0.22 | 6.51 | — |
| 3 | MS-9 | 297.50 | 0.27 | 6.46 | — |
| 4 | MS-3 | 262.90 | 0.24 | 6.49 | — |
| 5 | MS-6 | 471.56 | 0.42 | 6.31 | — |
| 6 | MS-1 | 666.45 | 0.59 | — | 6.14 |
| 7 | MS-11 | 241.43 | 0.22 | — | 6.51 |
| 8 | MS-9 | 297.50 | 0.27 | — | 6.46 |
| 9 | MS-3 | 262.90 | 0.24 | — | 6.49 |
| 10 | MS-6 | 471.56 | 0.42 | — | 6.31 |
| 11 | MS-1 | 666.45 | 0.59 | 5.81 | — |
| 12 | MS-2 | 474.39 | 0.23 | 6.50 | — |
| 13 | MS-3 | 262.90 | 0.24 | 6.49 | — |
| 14 | MS-4 | 287.54 | 0.26 | 6.47 | — |
| 15 | MS-5 | 159.60 | 0.14 | 6.59 | — |
| 16 | MS-6 | 471.56 | 0.42 | 6.31 | — |
| 17 | MS-8 | 290.31 | 0.26 | 6.47 | — |
| 18 | MS-9 | 297.50 | 0.24 | 6.46 | — |
| 19 | MS-1 | 666.45 | 0.59 | — | 6.14 |
| 20 | MS-2 | 474.39 | 0.23 | — | 6.50 |
| 21 | MS-3 | 262.90 | 0.24 | — | 6.49 |
| 22 | MS-4 | 287.54 | 0.26 | — | 6.47 |
| 23 | MS-5 | 159.60 | 0.14 | — | 6.59 |
| 24 | MS-6 | 471.56 | 0.42 | — | 6.31 |
| 25 | MS-7 | 375.10 | 0.33 | — | 6.39 |
| 26 | MS-8 | 290.80 | 0.26 | — | 6.47 |
| 27 | MS-9 | 297.50 | 0.24 | — | 6.46 |
| 28 | MS-10 | 404.00 | 0.36 | — | 6.37 |
| 29 | MS-11 | 241.43 | 0.22 | — | 6.51 |

Example 2

Hydrolytic Stability of Receiver Polymers

Hydrolysis was measured by sealing a 10 $cm^2$ sample of the receiving elements as listed in Table 3 and 75 μL of distilled water in a glass vial with a crimp cap. The vials were then incubated at 50° C. for fourteen days. After removal from the heating bath and cooling to room temperature, two mL of acetone containing an internal standard were added to each vial via syringe through the sealing cap. The vials were agitated vigorously for five minutes, the caps removed, the liquid filtered through a 0.45 μm glass microfiber filter, and analyzed by gas chromatography for butanol content versus external standards. The percent hydrolysis represents the percent of the theoretical amount based on coated weight of the polymer and its composition. The following Table 3 shows the hydrolytic stability of Control Receiver Element C-1 and various Receiver Elements of the invention:

TABLE 3

| Receiver | % Hydrolysis |
|---|---|
| Control C-1 | 4.60 |
| 1 | 0.07 |
| 3 | 0.00 |
| 6 | 0.02 |
| 8 | 0.00 |
| 9 | 0.02 |
| 11 | 0.01 |
| 14 | 0.23 |
| 16 | 0.00 |
| 19 | 0.00 |

The above results show that Control Receiver Element C-1 is subject to hydrolysis of ester side chains. Hydrolysis of these side chains will cause changes in the nature of the polymer layer over time which are undesirable, such as an increase in hydrophilicity, tackiness and changes in sensitometry. In contrast thereto, the receiver elements of the invention showed no or very little hydrolysis of ester side chains.

Example 3

Hydrolytic Stability Testing

The polyester in Control Receiver Element C-5 was coated on an unsubbed Estar® support at 540 $mg/ft^2$. The coating was then incubated at 50° C. and 50% RH for one week. A control sample of the coating was kept in a freezer for one week. Subsequently, both the incubated and freezer polymer coatings were dissolved off the support with tetrahydrofuran.

The dissolved coatings were then analyzed by size exclusion chromatography on a column system comprised of two Waters HT 6E and one HT 2E Styragel® mixed bed columns using N,N-dimethyformamide as elution solvent to give poly(ethylene oxide) equivalent molecular weight. The system was standardized using known molecular weight poly (ethylene oxide) standards. The molecular weight of the polyester decreased from 8030 to 583 after incubation for one week at 50° C. and 50% RH, while the freezer polymer did not decrease significantly. This shows that the polyester backbone in C-5 is unstable in strongly acidic environments, which results in degradation of physical properties.

Example 4

Preparation and Evaluation of Thermal Dye Transfer Images

Eleven-step sensitometric cyan thermal dye transfer images were prepared from the above dye-donor and dye-receiver elements. The dye side of the dye-donor element approximately 10 cm×15 cm in area was placed in contact with a receiving-layer side of a dye-receiving element of the same area. This assemblage was clamped to a stepper motor-driven, 60 mm diameter rubber roller. A thermal head (TDK No. 8I0625 with a resolution of 5.4 dots/mm, thermostatted at 25° C.) was pressed with a force of 24.4 Newton (2.5 kg) against the dye donor element side of the assemblage, pushing it against the rubber roller.

The imaging electronics were activated causing the donor-receiver assemblage to be drawn through the print head/roller nip at 40.3 mm/sec. Coincidentally, the resistive elements in the thermal print head were pulsed for 127.75 μs/pulse at 130.75 μs intervals during a 4.575 msec/dot printing cycle (including a 0.391 msec/dot cool-down interval). A stepped image density was generated by incrementally increasing the number of pulses/dot from a minimum of 0 to a maximum of 32 pulses/dot. The voltage supplied to the thermal head was approximately 12.5 v resulting in an instantaneous peak power of 0.294 watts/dot and a maximum total energy of 1.20 mJ/dot. This procedure was done using the cyan dye-donor element to produce a cyan stepped image. Print room humidity: 56%–62% RH.

For images containing a cyan dye (cyan or green image), protonation causes a color change from the deprotonated dye form (magenta) to the protonated dye form (cyan). This color change can be monitored by measuring status A red (cyan) and green (magenta) densities and calculating a red/green ratio as a function of time.

After printing, the dye-donor element was separated from the imaged receiving element. The prints were then placed into a 50° C./50% RH oven for 3.0 hours. Prints were removed from the oven and the Status A reflection red and green densities at step 10 in the stepped-image were measured for the cyan image using an X-Rite 820° Reflection Densitometer (X-Rite Corp.). A red/green (R/G) ratio (minus the baseline) was calculated for the cyan image for each receiver. Complete dye reprotonation of the cyan dye in the cyan image occurs when the red/green ratio after incubation is greater than 2.0. The results are summarized in the following Table 4:

TABLE 4

| Receiver Element | Red Density, 3 hrs.[1] | Green Density, 3 hrs.[2] | R/G Ratio 3 hrs., inc.[3] |
|---|---|---|---|
| 11 | 1.96 | 0.45 | 4.36 |
| 12 | 2.08 | 0.46 | 4.52 |
| 13 | 2.01 | 0.47 | 4.28 |
| 14 | 2.04 | 0.46 | 4.43 |
| 15 | 1.92 | 0.41 | 4.68 |
| 16 | 2.05 | 0.45 | 4.56 |
| 17 | 2.00 | 0.46 | 4.35 |
| 18 | 1.63 | 0.36 | 4.53 |
| 19 | 1.68 | 0.48 | 3.50 |
| 20 | 1.64 | 0.41 | 4.00 |
| 21 | 1.64 | 0.40 | 4.10 |
| 22 | 1.62 | 0.37 | 4.38 |
| 23 | 1.58 | 0.37 | 4.27 |
| 24 | 1.61 | 0.44 | 3.66 |
| 25 | 1.72 | 0.46 | 3.74 |
| 26 | 1.61 | 0.38 | 4.24 |
| 27 | 1.68 | 0.41 | 4.10 |
| 28 | 1.66 | 0.43 | 3.86 |
| 29 | 1.64 | 0.44 | 3.73 |
| C-2[4] | — | — | — |
| C-3[4] | — | — | — |
| C-4 | 0.38 | 1.03 | 0.37 |
| C-5 | 1.88 | 0.34 | 5.53 |
| C-6[5] | 0.65 | 1.07 | 0.61 |
| C-7[5] | 0.70 | 1.13 | 0.62 |

[1]red density for cyan image after 3 hrs. at 50° C./50% RH
[2]green density for cyan image after 3 hrs. at 50° C./50% RH
[3]red/green ratio for cyan image after 3 hrs. at 50° C./50% RH
[4]poor print quality and very low density was obtained, and red and green densities could not be measured.
[5]transferred dyes did not reprotonate and the transferred image remained magenta in color.

The above results show that mixing a hydrated transition metal salt of a strong acid and a vinyl polymer of no or slight acidity (Receiver Elements 11 through 29) results in the protonation of the transferred deprotonated dye in amounts comparable to that achieved with the control receiver element of C-5. Although a high R/G ratio was achieved with control C-5, the polymer in the receiver was found to be hydrolytically unstable (see Example 3). Those receiver elements that did not contain a hydrated transition metal salt (Controls C-6 and C-7) or that contained ethyl acetoacetate aluminum diisopropylate (Control C-4) did not protonate the deprotonated dye. In addition, print quality was quite poor for receiver elements C-2 and C-3, and red and green densities could not be measured.

Example 5

Preparation of Receiver Elements

Control Receiver Element C-8

This element was prepared the same as C-5 except that the dye-receiving layer was poly[isophthalic acid-co-5-sulfoisophthalic acid (90:10 molar ratio)-diethylene glycol (100 molar ratio), (sulfonic acid of AQ29, Eastman Chemical Company), (2.36 g/m$^2$), P-1 (2.31 g/m$^2$), Dowfax 2A1®, anionic surfactant (0.047 g/m$^2$), succinic acid (0.097 g/m$^2$), and colloidal silica particles (Snowtex ST-O®, Nissan Chemical Company) (1.076 g/m$^2$) coated from distilled water.

Receiver Element 30

Receiver Element 30 of the invention was prepared similar to Control Receiving Element C-8 except that the dye-receiving layer was polymer P-3, (5.38 g/m$^2$) and aluminum sulfate (Aldrich Chemical Company) (0.33 g/m$^2$) coated from distilled water was added as indicated in Table 5.

Receiver Elements 31–36

Receiver Elements 31–36 were prepared the same as Receiver Element 30, using polymers and metal salts as indicated in the following Table 5:

TABLE 5

| Receiver Element | Metal Salt (MS) | MW of MS | Laydown of MS (g/m$^2$) | Polymer | Laydown of Polymer (g/m$^2$) |
|---|---|---|---|---|---|
| 30 | MS-1 | 666.45 | 0.33 | P-3 | 5.38 |
| 31 | MS-1 | 666.45 | 0.33 | P-4 | 5.38 |
| 32 | MS-1 | 666.45 | 0.33 | P-5 | 5.38 |
| 33 | MS-1 | 666.45 | 0.33 | P-6 | 5.38 |
| 34 | MS-1 | 666.45 | 0.33 | P-7 | 5.38 |
| 35 | MS-7 | 375.14 | 0.21 | P-7 | 5.38 |
| 36 | MS-10 | 404.00 | 0.23 | P-7 | 5.38 |

Example 6

Preparation of Thermal Dye Transfer Images

Example 4 was repeated using Control Receiver Element C-8 and Elements of the invention 30–36. The following results were obtained:

TABLE 6

| Receiver Element | R/G ratio, incubated |
|---|---|
| Control C-8 | 5.2 |
| 30 | 2.9 |
| 31 | 3.5 |
| 32 | 2.6 |
| 33 | 2.4 |
| 34 | 3.8 |
| 35 | 3.4 |
| 36 | 3.4 |

The R/G ratio listed is an indication of the reprotonation of the deprotonated dye. Receiver elements that do not protonate the deprotonated dye have R/G ratios of less than 2. As the above data show, the receiver elements of the invention do reprotonate the deprotonated dyes (R/G ratio greater than 2). Although a high R/G ratio was achieved with control C-8, the polyester polymer in the receiver was found to be hydrolytically unstable (see Example 3).

The invention has been described in detail with particular reference to preferred embodiments thereof, but it will be understood that variations and modifications can be effected within the spirit and scope of the invention.

What is claimed is:

1. A thermal dye transfer assemblage comprising:

(I) a dye-donor element comprising a support having thereon sequentially repeating dye layer patches of a dye dispersed in a polymeric binder, at least one of said dye patches containing a deprotonated cationic dye which is capable of being reprotonated to a cationic dye having a N—H group which is part of a conjugated system; and (II) a dye-receiving element comprising a support having thereon a polymeric dye image-receiving layer comprising a vinyl polymer having no or only slight acidity and a hydrated transition metal or metalloid salt of a strong acid, said dye-receiving element being in a superposed relationship with said dye-donor element so that said dye layer is in contact with said polymeric dye image-receiving layer.

2. The assemblage of claim 1 wherein said vinyl polymer comprises repeating units derived from acrylic acid, styrene, or esters or amides of acrylic acid.

3. The assemblage of claim 2 wherein said vinyl polymer is poly(butyl acrylate-co-allyl methacrylate) core with poly (glycidyl methacrylate) shell, poly(methyl methacrylate-co-butyl acrylate-co-2-hydroxyethyl methacrylate-co-2-sulfoethyl methacrylate, sodium salt), poly(styrene-co-butyl methacrylate-co-hydroxyethyl acrylate), poly(styrene-co-butyl methacrylate-co-methacrylamide), poly(styrene-co-butyl methacrylate-co-N,N-dimethylacrylamide), poly (styrene-co-butyl methacrylate-co-ethoxyethyl methacrylate), poly(butyl methacrylate-co-acrylamide) or poly(butyl methacrylate-co-styrene-co-acrylamide).

4. The assemblage of claim 1 wherein said hydrated transition metal or metalloid salt of a strong acid is a hydrated form of: aluminum sulfate, aluminum nitrate, aluminum chloride, potassium aluminum sulfate, zinc sulfate, zinc nitrate, zinc chloride, nickel sulfate, nickel nitrate, nickel chloride, ferric sulfate, ferric chloride, ferric nitrate, cupric sulfate, cupric chloride, cupric nitrate, antimony (III) chloride, cobalt (II) chloride, ferrous sulfate, stannic chloride, aluminum trichloroacetate, zinc bromide, aluminum tosylate, or zirconium (IV) chloride.

5. The assemblage of claim 1 wherein said receiving layer contains $Al_2(SO_4)_3 \cdot 18H_2O$, $AlK(SO_4)_2 \cdot 12H_2O$, $NiSO_4 \cdot 6H_2O$, $ZnSO_4 \cdot 7H_2O$, $CuSO_4 \cdot 5H_2O$, $Fe_2(SO_4)_3 \cdot 4H_2O$, $Al(NO_3)_3 \cdot 9H_2O$, $Ni(NO_3)_2 \cdot 6H_2O$, $Zn(NO_3)_2 \cdot 6H_2O$, $Fe(NO_3)_3 \cdot 9H_2O$ or $AlCl_3 \cdot 6H_2O$.

6. The assemblage of claim 1 wherein said hydrated transition metal or metalloid salt of a strong acid is employed at a concentration of from about 0.05 to about 1.5 $g/m^2$.

7. A process of forming a dye transfer image comprising imagewise-heating a dye-donor element comprising a support having thereon a dye layer comprising a dye dispersed in a polymeric binder, and imagewise transferring said dye to a dye-receiving element to form said dye transfer image, wherein said dye-donor element comprises a support having thereon sequentially repeating dye layer patches of a dye dispersed in a polymeric binder, at least one of said dye patches containing a deprotonated cationic dye which is capable of being reprotonated to a cationic dye having a N—H group which is part of a conjugated system; and said dye-receiving element comprises a support having thereon a polymeric dye image-receiving layer comprising a vinyl polymer having no or only slight acidity and a hydrated transition metal or metalloid salt of a strong acid.

8. The process of claim 7 wherein said vinyl polymer comprises repeating units derived from acrylic acid, styrene, or esters or amides of acrylic acid.

9. The process of claim 8 wherein said vinyl polymer is poly(butyl acrylate-co-allyl methacrylate) core with poly (glycidyl methacrylate) shell, poly(methyl methacrylate-co-butyl acrylate-co-2-hydroxyethyl methacrylate-co-2-sulfoethyl methacrylate, sodium salt), poly(styrene-co-butyl methacrylate-co-hydroxyethyl acrylate), poly(styrene-co-butyl methacrylate-co-methacrylamide), poly(styrene-co-butyl methacrylate-co-N,N-dimethylacrylamide), poly (styrene-co-butyl methacrylate-co-ethoxyethyl methacrylate), poly(butyl methacrylate-co-acrylamide) or poly(butyl methacrylate-co-styrene-co-acrylamide).

10. The process of claim 7 wherein said hydrated transition metal or metalloid salt of a strong acid is a hydrated form of: aluminum sulfate, aluminum nitrate, aluminum chloride, potassium aluminum sulfate, zinc sulfate, zinc nitrate, zinc chloride, nickel sulfate, nickel nitrate, nickel chloride, ferric sulfate, ferric chloride, ferric nitrate, cupric sulfate, cupric chloride, cupric nitrate, antimony (III) chloride, cobalt (II) chloride, ferrous sulfate, stannic chloride, aluminum trichloroacetate, zinc bromide, aluminum tosylate, or zirconium (IV) chloride.

11. The process of claim 7 wherein said receiving layer contains $Al_2(SO_4)_3 \cdot 8H_2O$, $AlK(SO_4)_2 \cdot 12H_2O$, $NiSO_4 \cdot 6H_2O$, $ZnSO_4 \cdot 7H_2O$, $CuSO_4 \cdot 5H_2O$, $Fe_2(SO_4)_3 \cdot 4H_2O$, $Al(NO_3)_3 \cdot 9H_2O$, $Ni(NO_3)_2 \cdot 6H_2O$, $Zn(NO_3)_2 \cdot 6H_2O$, $Fe(NO_3)_3 \cdot 9H_2O$ or $AlCl_3 \cdot 6H_2O$.

12. The process of claim 7 wherein said hydrated transition metal or metalloid salt of a strong acid is employed at a concentration of from about 0.05 to about 1.5 $g/m^2$.

* * * * *